US010343010B2

(12) United States Patent
Chen

(10) Patent No.: US 10,343,010 B2
(45) Date of Patent: Jul. 9, 2019

(54) ADJUSTABLE DUMBBELL

(71) Applicant: Paul Chen, Vancouver (CA)

(72) Inventor: Paul Chen, Vancouver (CA)

( * ) Notice: Subject to any disclaimer, the term of this patent is extended or adjusted under 35 U.S.C. 154(b) by 422 days.

(21) Appl. No.: 15/271,248

(22) Filed: Sep. 21, 2016

(65) Prior Publication Data

US 2018/0078810 A1 Mar. 22, 2018

(51) Int. Cl.

| | |
|---|---|
| ***A63B 71/00*** | (2006.01) |
| ***A63B 21/072*** | (2006.01) |
| ***A63B 21/075*** | (2006.01) |

(52) U.S. Cl.

CPC ..... *A63B 21/075* (2013.01); *A63B 21/0726* (2013.01); *A63B 71/0036* (2013.01)

(58) Field of Classification Search

CPC ..... A63B 21/072–075

See application file for complete search history.

(56) References Cited

U.S. PATENT DOCUMENTS

| | | | | |
|---|---|---|---|---|
| 5,407,413 | A | 4/1995 | Kupferman | |
| 5,839,997 | A | 11/1998 | Roth et al. | |
| 6,656,093 | B2 | 12/2003 | Chen | |
| 7,223,214 | B2 | 5/2007 | Chen | |
| 7,731,641 | B1 | 6/2010 | Chen | |
| 7,811,213 | B2 | 10/2010 | Chen | |
| 7,887,469 | B1 | 2/2011 | Chen | |
| 2016/0089575 | A1* | 3/2016 | Smith | H04M 1/72533 482/5 |

* cited by examiner

*Primary Examiner* — Jennifer M Deichl

(74) *Attorney, Agent, or Firm* — Charles E. Baxley

(57) ABSTRACT

An adjustable dumbbell device includes a handle bar, a housing attached to one end of the handle bar, a weight element engageable into the housing, a pawl slidably received and engaged in the housing, and an actuating device rotatably engaged onto the handle bar and having a cam member for engaging with the pawl and for actuating the pawl to engage with the weight element and for detachably anchoring the weight element to the housing and the handle bar. The housing includes a guide channel for slidably engaging with the pawl, and a guide pin engaged with the pawl for guiding and limiting the pawl to slide relative to the housing.

7 Claims, 8 Drawing Sheets

ADJUSTABLE DUMBBELL

BACKGROUND OF THE INVENTION

1. Field of the Invention

The present invention relates to an adjustable dumbbell, and more particularly to an adjustable dumbbell assembly having an easily and quickly adjustable structure and having a relatively decreased weight for the adjustable dumbbell.

2. Description of the Prior Art

Various kinds of typical adjustable dumbbells have been developed and provided for conducting various exercise operations, for example, U.S. Pat. No. 5,407,413 to Kupferman, U.S. Pat. No. 5,839,997 to Roth et al., U.S. Pat. No. 6,656,093 to Chen, U.S. Pat. No. 7,223,214 to Chen, U.S. Pat. No. 7,731,641 to Chen, U.S. Pat. No. 7,811,213 to Chen, and U.S. Pat. No. 7,887,469 to Chen disclose several of the typical adjustable dumbbells each including a number of weight rings that may be selectively or adjustably secured together for adjusting the weight of the dumbbells.

Normally, in the typical adjustable dumbbells, two extension carriers or tracks are formed or provided on the end portions or extended outwardly from the end portions of the central handle bar, and the weight rings may be selectively or adjustably secured to the extension carriers or tracks.

However, the extension carriers or tracks are required to be permanently formed or provided on the end portions of the central handle bar such that the extension carriers or tracks and the central handle bar may form and may include a greatly increased length for the typical adjustable dumbbells.

In addition, the handle of the typical adjustable dumbbells may not be used for attaching or detaching the other weight rings or weight members.

The present invention has arisen to mitigate and/or obviate the afore-described disadvantages of the conventional adjustable dumbbells.

SUMMARY OF THE INVENTION

The primary objective of the present invention is to provide an adjustable dumbbell assembly including a structure that may be easily and quickly adjusted to different weights and that include the other weight rings or weight members attachable to a handle device thereof.

The other objective of the present invention is to provide an adjustable dumbbell assembly including a structure having no extension carriers or tracks formed or provided on the end portions or extended outwardly from the end portions of the central handle bar such that the total length of the dumbbell assembly may be selectively decreased.

In accordance with one aspect of the invention, there is provided an adjustable dumbbell assembly comprising a handle bar including a first end and a second end, a housing attached to the first end of the handle bar, a weight element engageable into the housing, a pawl slidably received and engaged in the housing, and an actuating device rotatably engaged onto the handle bar and including a cam member for engaging with the pawl and for actuating the pawl to engage with the weight element and for detachably anchoring the weight element to the housing and the handle bar.

The housing includes a guide channel formed therein for slidably receiving and engaging with the pawl. The housing includes a guide pin extended into the guide channel of the housing, and the pawl includes an oblong hole formed therein for slidably receiving and engaging with the guide pin and for guiding and limiting the pawl to slide relative to the housing.

The housing includes a chamber formed therein for slidably receiving and engaging with the weight element. The weight element includes a notch formed therein, and the pawl includes a tongue for selectively engaging with the notch of the weight element. A knob may further be provided and rotatably engaged onto the handle bar and coupled to the actuating device for rotating the actuating device relative to the housing and the handle bar.

The housing includes a first depression and a second depression formed therein, and the knob includes a sliding member slidably attached to the knob for engaging with either of the first or the second depressions of the housing and for anchoring the knob to the housing and the handle bar at an angular position. A weight member may further be provided, and a latch may further be provided and slidably engaged with the handle bar for detachably securing the weight member to the handle bar.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
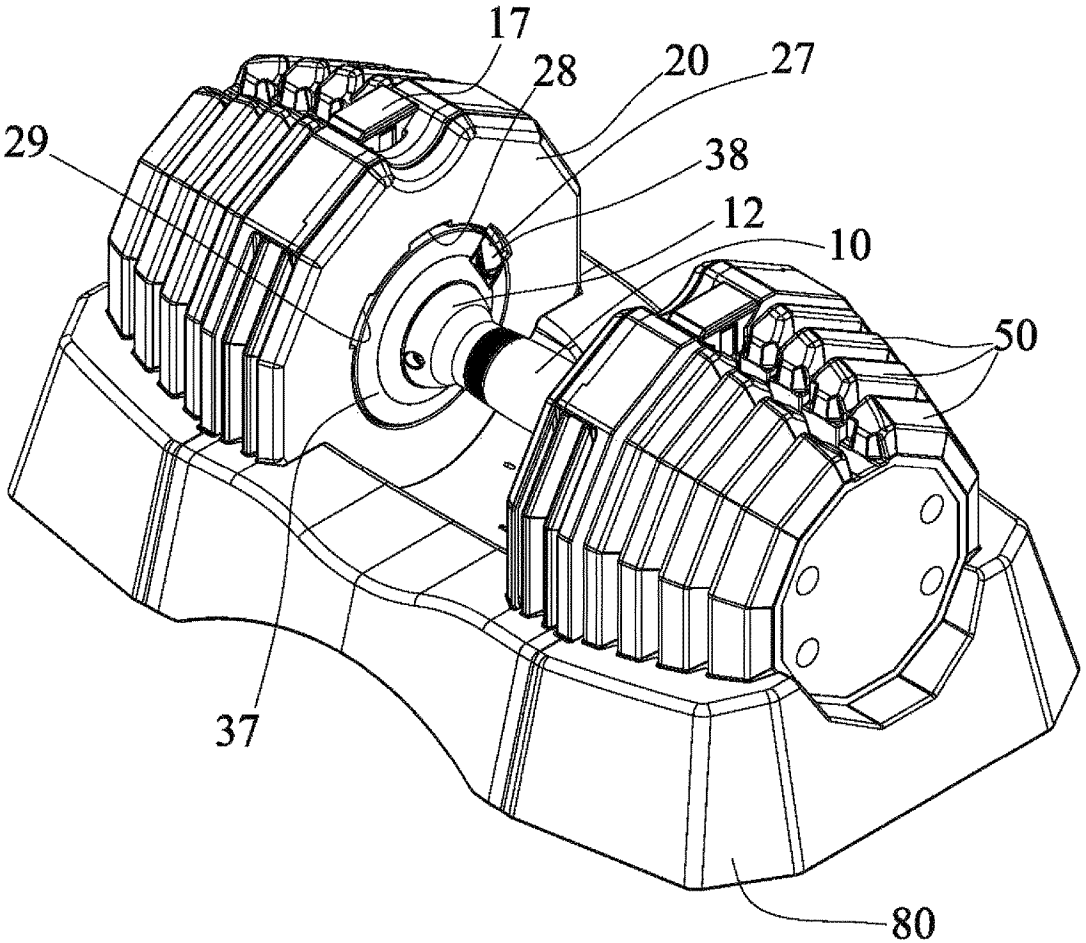
FIG. 1 is an upper perspective view of an adjustable dumbbell assembly in accordance with the present invention.
Figure 3:
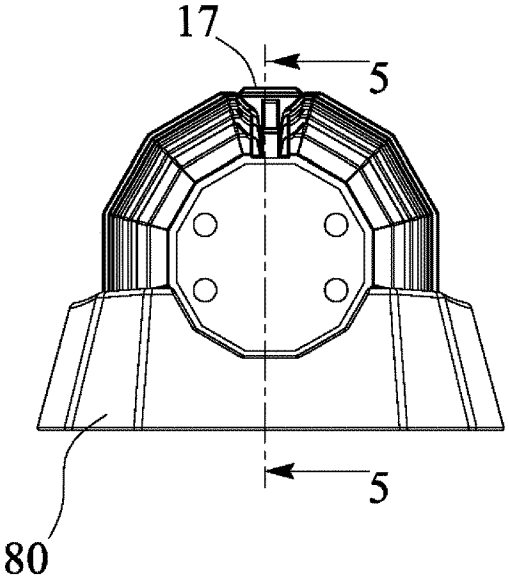
FIG. 3 is an end plan schematic view of the adjustable dumbbell assembly.
Figure 2:
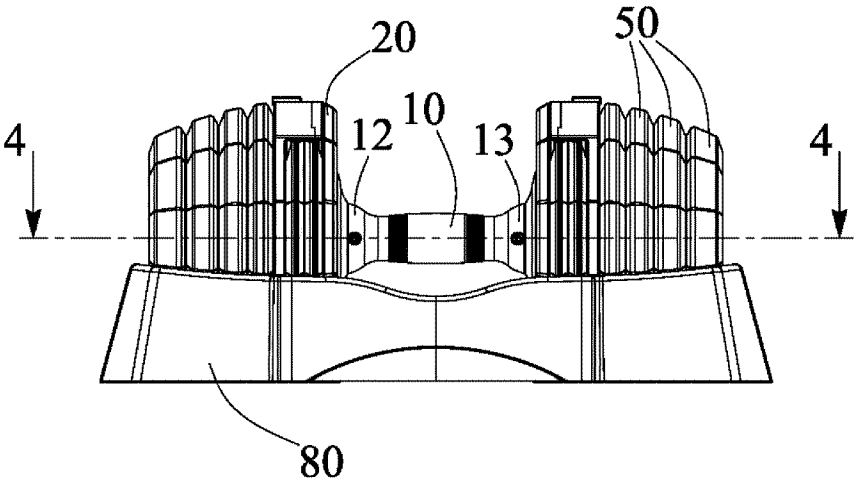
FIG. 2 is a front plan schematic view of the adjustable dumbbell assembly.
Figure 4:
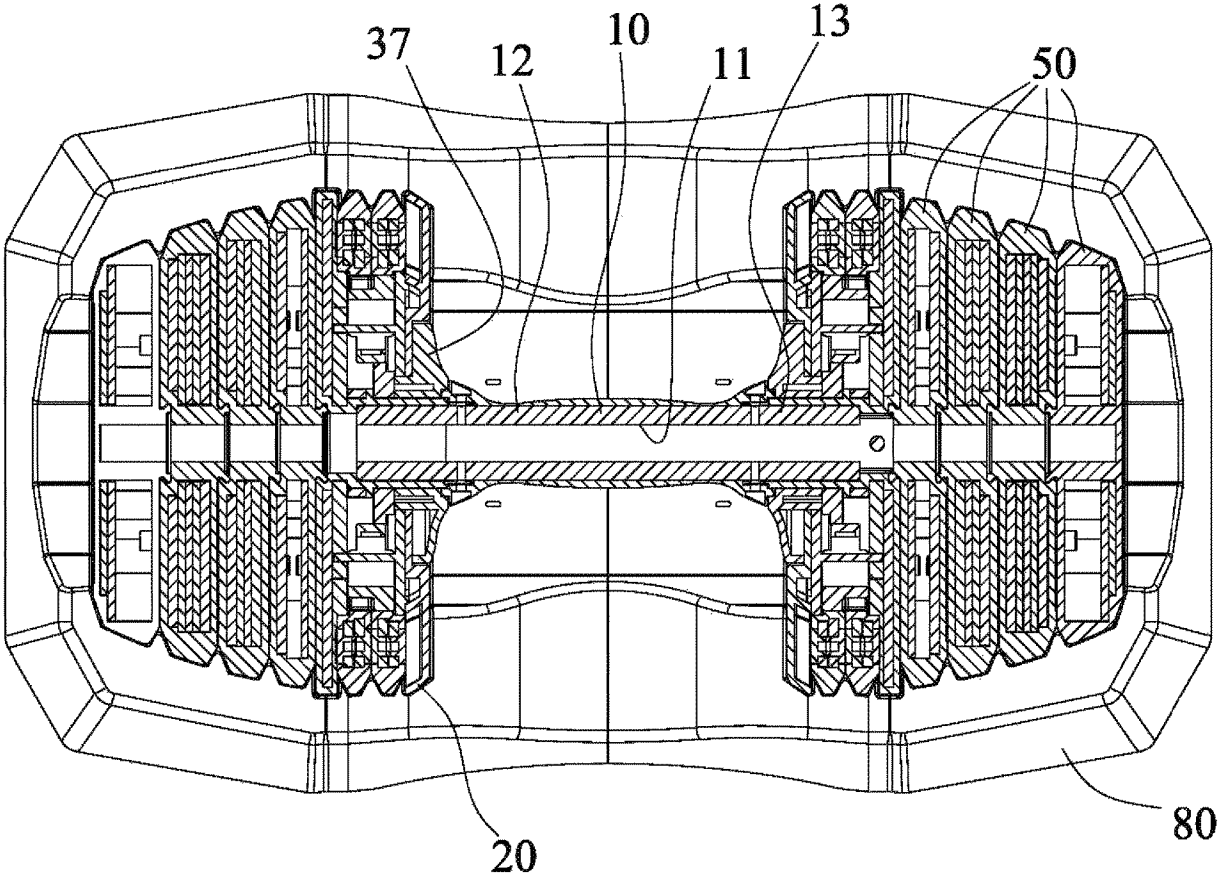
FIGS. 4, 5 are cross sectional views of the adjustable dumbbell assembly, taken along lines 4-4, 5-5 of FIGS. 2 and 3 respectively.
Figure 5:
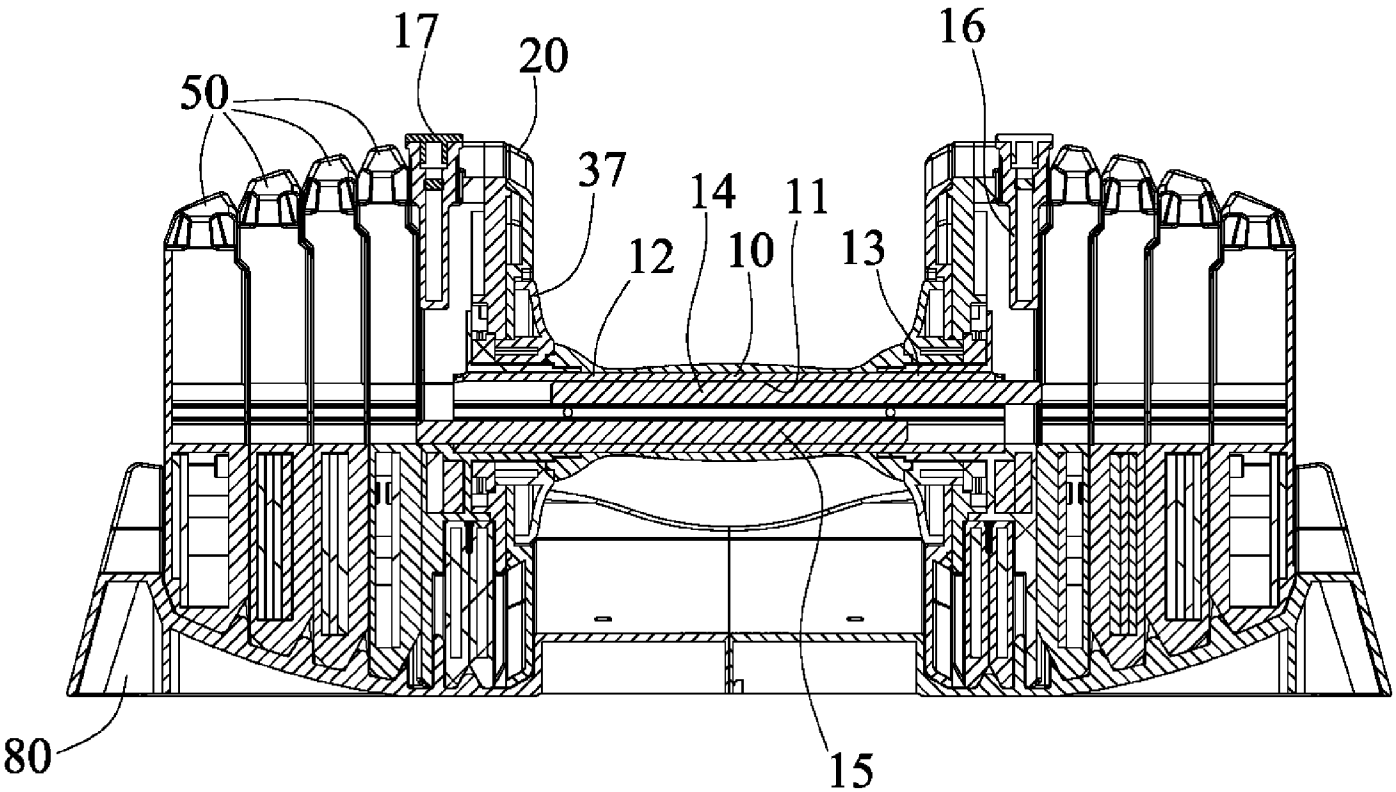
Figure 6:
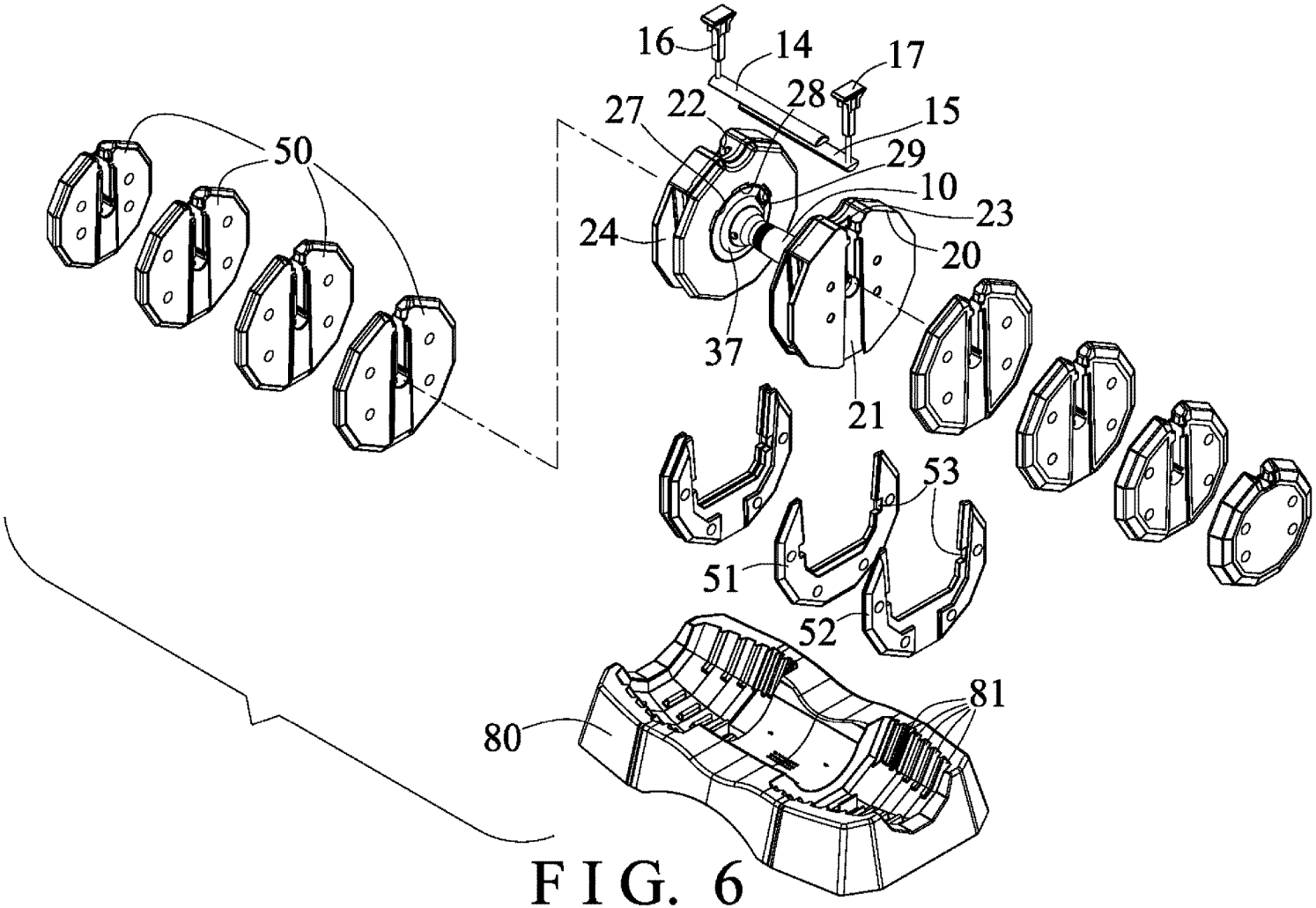
FIG. 6 is a partial exploded view of the adjustable dumbbell assembly.
Figure 7:
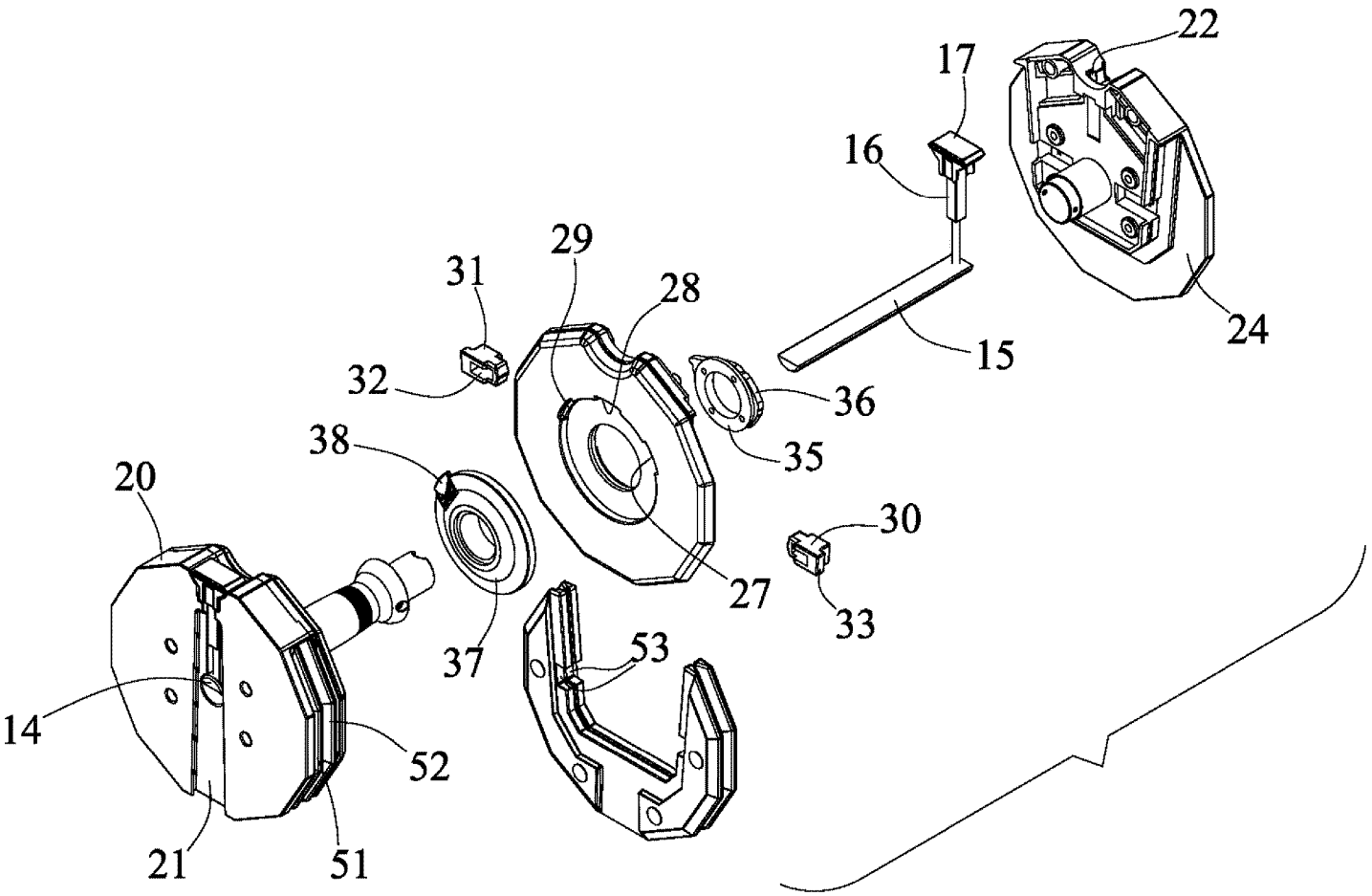
FIG. 7 is an enlarged partial exploded view of the adjustable dumbbell assembly as seen from one direction of the adjustable dumbbell assembly.
Figure 8:
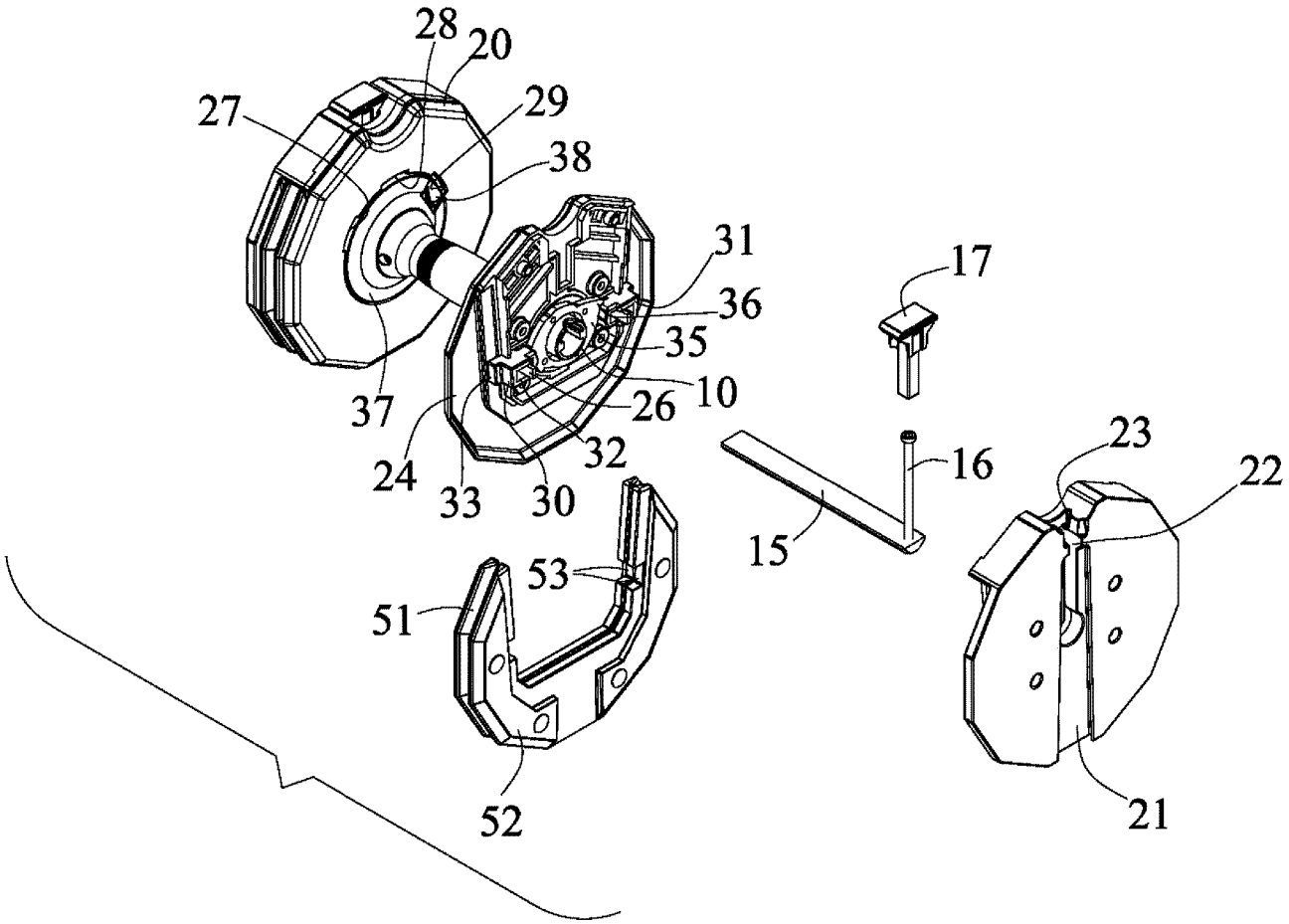
FIG. 8 is another enlarged partial exploded view of the adjustable dumbbell assembly as seen from another direction opposite to that shown in FIG. 7.
Figure 9:
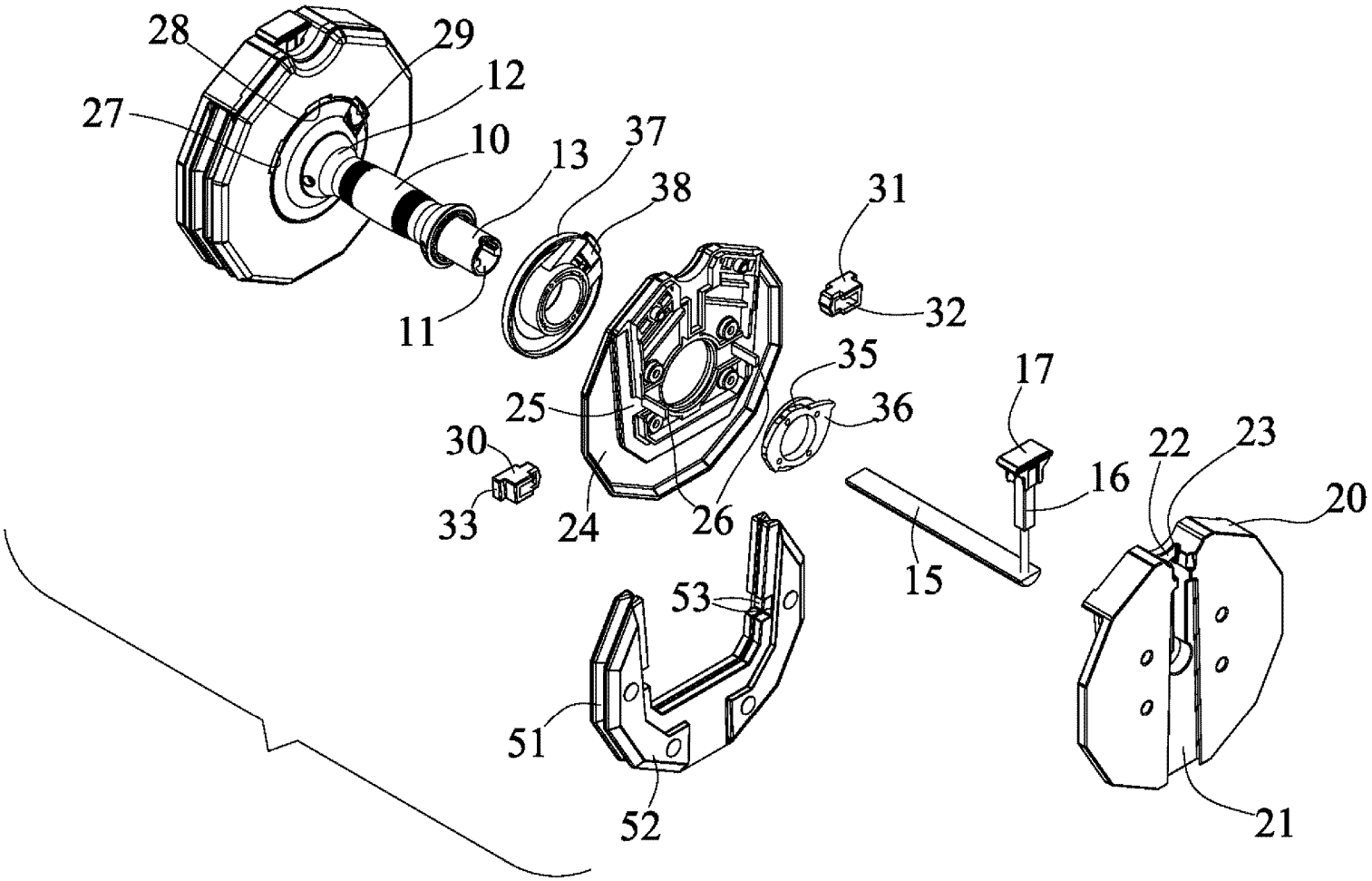
FIG. 9 is a further enlarged partial exploded view of the adjustable dumbbell assembly.

Referring to the drawings, and initially to FIGS. 1-6, an adjustable dumbbell assembly in accordance with the present invention comprises a central handle bar 10, and a number of weights 50, such as weight rings or plates or members 50 to be selectively or adjustably secured to the central handle bar 10, and to be easily and quickly adjusted to different weights for the adjustable dumbbell assembly. As shown in FIGS. 4-5, 9, the handle bar 10 includes an elongated or longitudinal hole or bore 11 formed therein, and includes one or more (such as two) end portions 12, 13 each having a plate or housing 20 extended radially and outwardly therefrom, the bore 11 of the handle bar 10 also formed through the housings 20, and the housings 20 each include a slot 21, such as a dovetail slot 21 formed therein (FIGS. 6-9), and communicating with the bore 11 of the handle bar 10.

The housings 20 each further include a cavity 22 formed therein, such as formed in the upper portion thereof and also communicating with the bore 11 of the handle bar 10, and each further include a shoulder or seat 23 formed or provided in the housing 20 and communicating with or located beside the cavity 22 of the housing 20 or of the handle bar 10. One or more (such as two) rods or latches 14, 15 (FIGS. 5-9) are slidably engaged in the bore 11 of the handle bar 10 and extendible out of the housing 20 and the end portions 12, 13 of the handle bar 10, for detachably or changeably or removably and/or adjustably attaching or mounting or securing the required or predetermined number of the weight members 50 to the housing 20 or the end portions 12, 13 of the handle bar 10. The attachment of the weight members 50 to the housing 20 or the end portions 12, 13 of the handle bar 10 with the latches 14, 15 is not related to the present invention and will not be described in further details. A base or receptacle 80 may further be provided and includes a number of recesses or depressions or socket openings 81 formed therein for selectively receiving or engaging with the weight members 50 and/or the housings 20.

A column or post 16 is threaded or attached or mounted to each of the latches 14, 15, and substantially perpendicular to the respective latch 14, 15, a spring biased knob or catch 17 is slidably attached or mounted or engaged onto the post 16 for selectively engaging with the cavity 22 of the housing 20 or of the handle bar 10, and/or for selectively engaging with the seat 23 of the housing 20 or of the handle bar 10, and for selectively anchoring or retaining or positioning the catch 17 and thus the latches 14, 15 to the housings 20 and the handle bar 10, and thus for preventing the catch 17 and the latches 14, 15 from moving or sliding relative to the handle bar 10. Similarly, the engagement of the latches 14, 15 with the weight members 50 is also not related to the present invention and will not be described in further details. The housings 20 each include a U-shaped compartment or chamber 24 formed therein for selectively and slidably receiving or engaging with one or more (such as two) weight elements 51, 52 which also include a U-shaped structure or configuration for selectively and detachably or changeably engaging with the corresponding U-shaped chamber 24 of the housing 20.

The housings 20 each further include a guide channel 25 formed therein (FIG. 9) for slidably receiving or engaging with one or more (such as two) tongues or pawls 30, 31, and one or more (such as two) guide pins 26 extended into the guide channel 25 of the housing 20, and the pawls 30, 31 each include an oblong hole 32 formed therein for slidably receiving or engaging with the guide pins 26 (FIG. 8) and for guiding and limiting the pawls 30, 31 to slide or move relative to the housing 20 and for preventing the pawls 30, 31 from being disengaged from the housing 20. The pawls 30, 31 each further include a projection or tongue 33 extended therefrom for selectively engaging with the weight elements 51, 52 and for selectively and detachably or changeably anchoring or retaining or positioning the weight elements 51, 52 to the housing 20 and the handle bar 10. For example, the weight elements 51, 52 each include one or more (such as two) notches 53 formed therein for selectively receiving or engaging with the tongues 33 of the pawls 30, 31.

One or more (such as two) actuating devices 35 are further provided and pivotally or rotatably engaged onto the handle bar 10 (FIGS. 7-9) and received and engaged in the housings 20 respectively, and each include a cam member 36 for selectively contacting or engaging with the pawls 30, 31 and for selectively forcing and actuating the pawls 30, 31 to engage with the weight elements 51, 52 and thus for selectively and detachably or changeably or removably anchoring or retaining or positioning the weight elements 51, 52 to the housing 20 and the handle bar 10. One or more (such as two) caps or knobs 37 may further be provided and also pivotally or rotatably engaged onto the handle bar 10 and arranged or located outside the housing 20, and attached or mounted or secured or coupled to the actuating devices 35 respectively for pivoting or rotating the actuating devices 35 relative to the housing 20 of the handle bar 10, in order to force and actuate the pawls 30, 31 to engage with the weight elements 51, 52 respectively.

The knobs 37 each further include a sliding member 38 slidably attached thereto or engaged thereon for selectively engaging with either of three notches or depressions 27, 28, 29 of the housing 20 and for anchoring or retaining or positioning the knobs 37 and the actuating devices 35 to the housings 20 of the handle bar 10 at the required or predetermined angular position, for example, when the sliding member 38 is engaged with one of the depressions 27 of the housing 20, the actuating devices 35 do not engage with and do not force and actuate the pawls 30, 31 to engage with the weight elements 51, 52. When the sliding member 38 is engaged with the other, such as the middle depression 28 of the housing 20, the cam members 36 of the actuating devices 35 may be engaged with the pawls 30, 31 in order to force and actuate the pawls 30, 31 to engage with one of the weight elements 51, 52, for example. When the sliding member 38 is engaged with the further depression 29 of the housing 20, the cam members 36 of the actuating devices 35 may be engaged with the pawls 30, 31 in order to force and actuate the pawls 30, 31 to engage with two or more of the weight elements 51, 52, for example.

In operation, as shown in FIGS. 1-6, the catch 17 may move and actuate the latches 14, 15 to engage with the required or selected or predetermined number of the weight members 50 for changeably or removably and/or adjustably attaching or mounting or securing the required or selected or predetermined number of the weight members 50 to the housing 20 or the end portions 12, 13 of the handle bar 10. The knobs 37 may also be pivoted or rotated relative to the housing 20 of the handle bar 10 for pivoting or rotating the actuating devices 35 relative to the housing 20 of the handle bar 10, in order to force and actuate the pawls 30, 31 to engage with the weight elements 51, 52 respectively, and so as to changeably or removably and/or adjustably attach or mount or secure the required or selected or predetermined number of the weight members 50 to the housing 20 or the end portions 12, 13 of the handle bar 10.

Accordingly, the adjustable dumbbell assembly in accordance with the present invention includes a structure that may be easily and quickly adjusted to different weights, and having no extension carriers or tracks formed or provided on the end portions or extended outwardly from the end portions of the central handle bar such that the total length of the dumbbell assembly may be selectively decreased.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable dumbbell assembly comprising:

a handle bar including a first end and a second end, a weight member, a latch slidably engaged with said handle bar for detachably securing said weight member to said handle bar, a housing attached to said first end of said handle bar, a weight element engageable into said housing, a pawl slidably received and engaged in said housing, and an actuating device rotatably engaged onto said handle bar and including a cam member for engaging with said pawl and for actuating said pawl to engage with said weight element and for detachably anchoring said weight element to said housing and said handle bar.

2. An adjustable dumbbell assembly comprising:

a handle bar including a first end and a second end, a housing attached to said first end of said handle bar, a weight element engageable into said housing, a pawl slidably received and engaged in said housing, and an actuating device rotatably engaged onto said handle bar and including a cam member for engaging with said pawl and for actuating said pawl to engage with said weight element and for detachably anchoring said weight element to said housing and said handle bar, wherein said housing includes a guide channel formed therein for slidably receiving and engaging with said pawl.

3. The adjustable dumbbell assembly as claimed in claim 2, wherein said housing includes a guide pin extended into said guide channel of said housing, and said pawl includes an oblong hole formed therein for slidably receiving and engaging with said guide pin and for guiding and limiting said pawl to slide relative to said housing.

4. The adjustable dumbbell assembly as claimed in claim 1, wherein said housing includes a chamber formed therein for slidably receiving and engaging with said weight element.

5. The adjustable dumbbell assembly as claimed in claim 1, wherein a knob rotatably engaged onto said handle bar and coupled to said actuating device for rotating said actuating device relative to said housing and said handle bar.

6. The adjustable dumbbell assembly as claimed in claim 5, wherein said housing includes a first depression and a second depression formed therein, and said knob includes a sliding member slidably attached to said knob for engaging with either of said first or said second depressions of said housing and for anchoring said knob to said housing and said handle bar at an angular position.

7. An adjustable dumbbell assembly comprising:

a handle bar including a first end and a second end, a housing attached to said first end of said handle bar, a weight element engageable into said housing, a pawl slidably received and engaged in said housing, and an actuating device rotatably engaged onto said handle bar and including a cam member for engaging with said pawl and for actuating said pawl to engage with said weight element and for detachably anchoring said weight element to said housing and said handle bar, wherein said weight element includes a notch formed therein, and said pawl includes a tongue for selectively engaging with said notch of said weight element.

* * * * *